United States Patent [19]

Day et al.

[11] 4,371,253

[45] Feb. 1, 1983

[54] COLOR ELECTROPHOTOGRAPHIC COPIER

[75] Inventors: Pierce B. Day, Pittsford; Carl M. Marsiglio, Spencerport, both of N.Y.

[73] Assignee: Eastman Kodak Company, Rochester, N.Y.

[21] Appl. No.: 226,306

[22] Filed: Jan. 19, 1981

[51] Int. Cl.[3] ..... G03G 15/01

[52] U.S. Cl. ..... 355/4; 350/166; 350/397; 350/439; 355/3 R; 355/32; 355/77

[58] Field of Search ..... 355/3 R, 4, 32, 35, 355/77; 350/166, 397, 398, 439

[56] References Cited

U.S. PATENT DOCUMENTS

| | | | |
|---|---|---|---|
| 2,742,837 | 4/1956 | Streiffert | 350/166 X |
| 3,085,468 | 4/1963 | Hehn | 355/35 |
| 3,690,756 | 9/1972 | Smith | 355/4 |
| 4,080,053 | 3/1978 | Friday | 355/3 T |
| 4,159,166 | 6/1979 | Kasahara et al. | 355/4 X |
| 4,229,095 | 10/1980 | Mir | 355/35 X |

*Primary Examiner*—Fred L. Braun
*Attorney, Agent, or Firm*—Lawrence P. Kessler

[57] ABSTRACT

A simplified optical arrangement for an electrophotographic copier for making multicolor reproductions of a multicolor original document. The copier includes at least one charged photoconductive member which is exposed by primary color separation images of an original document to form corresponding latent image charge patterns. The primary color separation images are projected onto the photoconductive member by the simplified optical arrangement which includes a catadioptric lens assembly optically located between the original document and the photoconductive member. The lens assembly includes relatively tilted dichroic mirrors spectrally sensitive respectively to the primary colors to separate an image of an original document into primary color separation images, and project such images respectively in straight line optical paths toward distinct spacial locations on the photoconductive member.

9 Claims, 2 Drawing Figures

P
12
14
D
18a
59a
18b
59b
18c
59c
58
58'
60

P
TO L
14
56
D
56
52
50
48
42a
44a
54a
16a
22a
59a
18a
56a
24a
26
54b
42b
44b
38
36b
18b
16b
22b
59b
24b
26
54c
42c
18c
22c
59c
16c
24c
26
36c
34
32
28
45
SWa
SWb
SWc
PROCESSING STATIONS/TRANSPORT
LOGIC AND CONTROL UNIT
L
FROM P
21
20
MOTOR
58
58'
60
64
62
66

COLOR ELECTROPHOTOGRAPHIC COPIER

BACKGROUND OF THE INVENTION

This invention relates generally to electrophotographic copiers, and more particularly to an electrophotographic copier for making multicolor reproductions of a multicolor original document.

In making multicolor reproductions with an electrophotographic copier, typically a light image of a multicolor original document is projected through primary color filters (red, green, and blue) to form color separation images. The color separation images expose a moving electrostatically charged photoconductive member. Exposure may take place sequentially by illuminating the document three times, and projecting the light images respectively through the color filters, or simultaneously by illuminating the document once and dividing the light image into color separation images such as by beam splitters or dichroic mirrors. Exposure forms latent image charge patterns in spaced areas on a photoconductive member corresponding to the color separation images. The latent image charge patterns are respectively developed with complimentary colored toner material (e.g., cyan, magenta, and yellow). The developed images are then transferred to a receiver sheet in registered superimposed relationship to form a multicolor reproduction of the multicolor original.

In an alternative color copier configuration, separation electrostatically charged photoconductive members are exposed by respective color separation images to form the latent image charge patterns. Of course, with plural photoconductive members, there is a duplication of certain of the copier mechanisms (e.g., photoconductive members, chargers, cleaning apparatus). However, steps of the copying process can be carried out in parallel. This results in an equal number of copies being reproduced per unit time (with respect to apparatus having one photoconductive member) at relatively reduced photoconductive member and receiver sheet transport velocities.

Optical mechanisms for exposure of the photoconductive member(s) in prior art color copiers are complex (see, for example, U.S. Pat. No. 3,690,756 issued Sept. 12, 1972 in the name of Smith, and U.S. Pat. No. 3,841,751 issued Oct. 15, 1974 in the name of Draugelis et al). The complexity arises, in part, from the need to space the elements of the optical mechanisms and accurately align the elements in their relative positions to insure projection of the respective light images toward desired spaced locations.

SUMMARY OF THE INVENTION

This invention is directed to a simplified optical arrangement for use in an electrophotographic copier for making multicolor reproductions of a multicolor original document. The copier includes a simplified optical arrangement for an electrophotographic copier for making multicolor reproductions of a multicolor original document. The copier includes at least one charged photoconductive member which is exposed by primary color separation images of an original document to form corresponding latent image charge patterns. The primary color separation images are projected onto the photoconductive member by the simplified optical arrangement which comprises a catadioptric lens assembly optically located between the original document and the photoconductive member. The lens assembly includes relatively tilted dichroic mirrors spectrally sensitive respectively to the primary colors to separate an image of an original document into primary color separation images and project such images respectively in straight line optical paths toward distinct spacial locations on the photoconductive member.

The invention, and its objects and advantages, will become more apparent in the detailed description of the preferred embodiment presented below.

BRIEF DESCRIPTION OF THE DRAWING

In the detailed description of the preferred embodiment of the invention presented below, reference is made to the accompanying drawings in which.

DESCRIPTION OF THE PREFERRED EMBODIMENT

Figure 1:
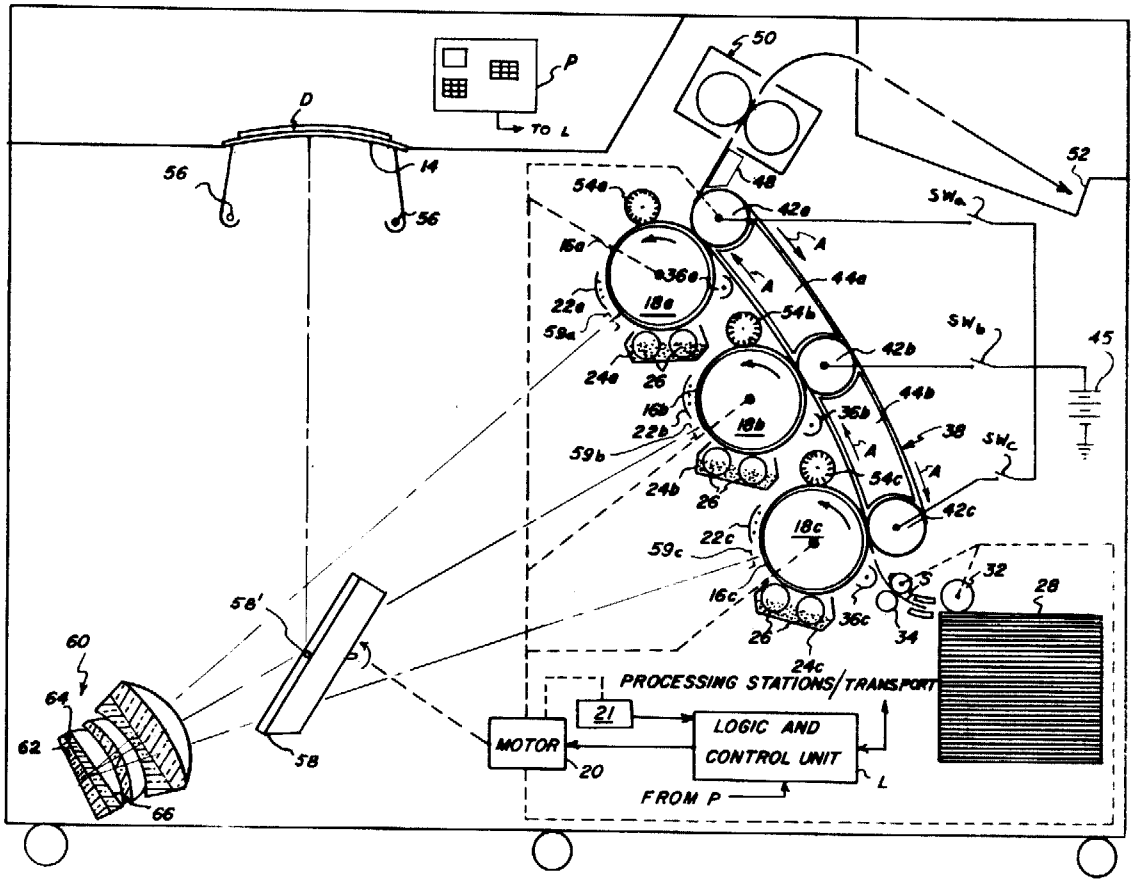
FIG. 1 is a schematic side elevational view, in cross-section, of a color electrophotographic copier including the optical arrangement according to this invention.

Referring now to the drawings, a color electrophotographic copier 10 is schematically shown having a housing 12 including a transparent platen 14 for supporting an original document to be copied. The copier 10 of the preferred embodiment includes a plurality of photoconductive members 16*a*, 16*b*, 16*c*, although other arrangement of photoconductive members could also be employed without departing from the socpe of this invention (e.g., one photoconductive member having a plurality of spaced image receiving areas). The photoconductive members are formed of photoconductive material, sensitive to light in the primary color rage (red, green, blue), fixed to conductive support material, such as described, for example, in U.S. Pat. No. 3,615,414 issued Oct. 26, 1971 in the name of Light. Of course the photoconductive material of the members could be individually tailored to be respectively sensitive to substantially one primary color. The members are respectively mounted on equal diameter, rotatable drums 18*a*, 18*b*, 18*c* supported in the housing. An electrical grounding path is provided for members through the drums. The drums are driven in a counterclockwise direction (when viewed in the direction of FIG. 1) by a motor 20.

The motor 20 is controlled by a copier logic and control unit L, which also controls the activation of the various processing stations and transport elements of the copier 10 in response to timing signals produced by the motor. Such timing signals are produced by a timing signal generator 21 such as described, for example, in U.S. Pat. No. 3,790,270 issued Feb. 5, 1974 in the name of Donohue. The logic and control unit includes, for example, an Intel 8080 microprocessor available from Intel Corporation of Sacramento, Calif. The unit L is operatively coupled to an operator programmable input and display panel P so as to receive input signals, such as the number of desired copies and a start copy cycle, produced by the panel.

When an original document is to be reproduced, the operator places the document (e.g., document D), information side down, on the transparent platen 14, and programs the panel P. On receiving the start copy cycle signal, the logic and control unit L turns on the motor 20 to rotate the drums 18*a*, 18*b*, and 18*c* and activates the timing generator 21 to initiate control of the processing stations. Particularly, D.C. or biased A.C. chargers 22a, 22b, 22c, located respectively in juxtaposition with the photoconductive members, are selectively turned on to electrostatically charge the respective members uniformally prior to exposure as they rotate past the chargers. The rotating members are then respectively exposed to primary color separation light images in the manner to be explained below. The members become conductive in the areas struck by light, leaving latent image charge patterns corresponding respectively to the primary color separation light images.

Developing stations 24a, 24b, 24c are supported in the housing 12 in juxtaposition with respective photoconductive members 16a, 16b, 16c. The developing stations are, for example, of the magnetic brush type disclosed in U.S. Pat. No. 3,543,720 issued Dec. 1, 1970 in the names of Drexler et al. Such developing stations contain triboelectrically charged carrier particles and marking particles respectively complementary to primary colors (i.e., cyan, magenta, and yellow). Specifically, if member 16a is to be exposed to a blue color separation image, the particles in station 24a are yellow. Then member 16b would be exposed to a green color separation image and the particles in station 24b would be magenta; and member 16c would be exposed to a red color separation image and the particles in station 24c would be cyan. The marking particles, are for example, of the type shown in U.S. Pat. No. 3,893,935, issued July 8, 1975 in the names of Jadwin et al. Magnetic brushes 26 bring the complimentary colored marking particles into contact with the respective photoconductive members. The latent image charge patterns on the members attract the marking particles so that the images are respectively developed to form complimentary color separation images.

At a preselected time in the copy cycle, as determined by the logic and control unit L, a receiver sheet (e.g., sheet S) is fed from the top of a stack of cut sheets 28. A sheet feed mechanism, such as a rotary vacuum feeder 32 driven by motor 20 removes the top sheet from the stack and delivers such sheet to a registration mechanism 34, such as shown in U.S. Pat. No. 4,019,732 issued Apr. 26, 1977 in the name of Hunt, Jr. et al. The registration mechanism, which is also driven by motor 20, is controlled by the unit L to align the sheet relative to the developed image on the moving photoconductive member 16c. Thus when the sheet is transported from the mechanism 34 into contact with such member the sheet is accurately registered with the developed image for transfer of the image to the sheet.

A transport 38 feeds the sheet successively past the drums 18c, 18b and 18a. The transport 38 includes a perforated belt 40 of dielectric material such as polypropylene, for example. The belt is entrained over conductive transfer rollers 42a, 42b, and 42c and vacuum plenums 44a, 44b. Rotation of the transfer rollers, induced by a drive mechanism, such as motor 20, causes the belt to traverse a closed loop path in the direction of arrows A at a speed substantially equal to the peripheral speed of the drums. The plenums 44a, 44b respectively have ported walls in juxtaposition with the run of the belt 40 facing the drums. Vacuum in the plenums is effective through the ported walls and the belt perforations to tack the sheet to the belt for movement therewith. As the sheet is transported along the portion of the path adjacent to the photoconductive members, it is brought into contact with member 16c, then member 16b and finally member 16a.

The transfer rollers 42a, 42b and 42c, which are for example of the type shown in U.S. Pat. No. 2,807,233 issued Sept. 24, 1957 in the name of Fitch, are coupled to a potential source 45 through respective switches SW*a*, SW*b*, SW*c*. The logic and control unit L respectively closes switches SW*a*, SW*b*, SW*c* to electrically connect the transfer rollers to the potential source in response to the contact of the receiver sheet with the respective photoconductive members. Of course, the transfer rollers could be respectively connected to independent potential sources tailored to optimize transfer for differing electrical characteristics of respective colored toner particles. The transfer rollers charge the receiver sheet to a level greater than that attracting the marking particles (forming the developed images) to the photoconductive members. The particles are therefore attracted from the respective photoconductive members to the receiver sheet, in image wise patterns, during respective contact with such members in the nips between the members and respective transfer rollers. Transfer of the images is facilitated by substantially neutralizing the attractive forces on the marking particles with charge from coronas 36a, 36b, 36c respectively associated with the drums 18a, 18b, 18c immediately upstream of the respective transfer nips.

The spacing of the drums 18a, 18b, 18c and their circumference are selected such that the nips of transfer rollers 42a, 42b and 42c and respective photoconductive members 16a, 16b, and 16c are separated by a distance equal to an exposure area plus the spacing between the trail edge of an exposure area and the lead edge of the next area to be exposed, in the direction of rotation of the drum. Therefore, when a receiver sheet is registered in the nip between roller 42c and member 16c relative to an image on member 16c, movement of such sheet by transport 38 brings the sheet to the subsequent nips in accurate timed relation relative to arrival of images on members 16b and 16a in the respective nips. Thus the transferred images are in accurate superimposed register.

After transfer at the nip between drum 18a and roller 42a, the sheet is delivered to a vacuum transport 48 which, in turn, delivers the sheet to a fuser apparatus 50. The fuser 50 includes a pair of pressure rollers at least one of which is heated, to permanently fix the registered transferred images to the sheet; see for example U.S. Pat. No. 4,199,626 issued Apr. 22, 1980 in the name of Stryjewski et al. After fusing, the sheet is delivered to a copy output tray 52 for operator retrieval. Meanwhile, subsequent to transfer, the photoconductive members are rotated in contact with respective rotating fur brushes 54a, 54b, 54c to clean the members of any residual marking particles. The brushes are substantially surrounded with respective vacuum housing (not shown) to remove the particles for transport to a storage container, see for example, U.S. Pat. No. 3,780,391 issued Dec. 25, 1973 in the name of Leenhouts. Further rotation of the drums then brings a cleaned portion of the photoconductive members to the area of the respective chargers 22a, 22b, 22c where the members are ready to be recharged in preparation for a repeat of the copy cycle.

In order to obtain the color separation light images of the document D on the platen 14, such document is illustrated for example by flourescent lamps 56 controlled by the unit L in response to the start of the copy cycle. A mirror 58 is rotatably supported on a pivot 58' in the path of the light image reflected from the document. The platen 14 lies on a portion of a cylinder having a longitudinal axis perpendicular to the plane of FIG. 1 intersecting the pivot 58' at its midpoint so that the distances between any element of the platen and the axis are equal to maintain the reflected light image of the document on the platen in focus. The mirror 58 is rotated about its support pivot 58' in a counter-clockwise direction (as viewed in FIG. 1), such as by motor 20, at a synchronous speed with respect to the rotation of the drums 18*a*, 18*b*, 18*c*, to scan the document from right to left. Specifically, the scanning speed at the document plane (from right to left) is substantially equal to the peripheral speed of the photoconductive members to prevent smearing of the reflected images projected onto the members. At the end of the document scan, the lamps are turned off and the mirror is relatively rapidly rotated in a clockwise direction to return the mirror to the position for the next scan. The return is accomplished, for example, during the time at which an interframe portion of the photoconductive members passes through the exposure area. Of course, other scanning arrangements could be employed in accordance with this invention.

Figure 2:
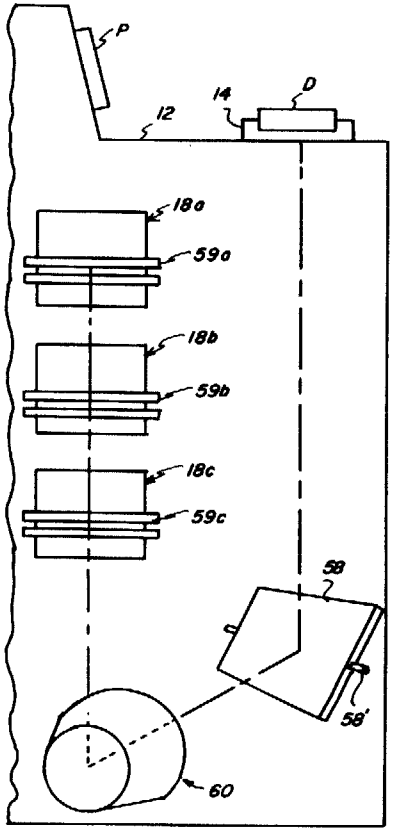
FIG. 2 is an end elevational view of the copier of FIG. 1, with portions removed to facilitate viewing, taken from the left of FIG. 1.

The reflected light image is projected from the mirror 58 to a catadioptric lens assembly 60. The lens assembly 60 further includes dichroic mirrors 62, 64, and 66, spectrally sensitive respectively to the primary colors for separating the reflected light image into primary color separation images. The dichroic mirrors are relatively tilted at angles selected so that the color separation images are projected along straight line optical paths respectively to exposure areas of photoconductive members 16*a*, 16*b*, 16*c* through respective slit apperatures 59*a*, 59*b*, and 59*c*. Specifically, if member 16*a* is to receive a blue color separation image, mirror 66 reflects a blue color separation image; then member 16*b* would receive a green color separation image reflected from mirror 64 and member 16*c* would receive a red color separation image reflected from mirror 62. The platen 14 and mirror 58 are disposed forwardly in the housing 12 (see FIG. 2) with respect to the lens assembly 60 and the photoconductive members. Further, the mirror 58 and the lens assembly 60 are disposed in parallel angular relationship to the plane of FIG. 1 to provide a folded optical path between the platen and the photoconductive members (see FIG. 2) so that the mirror does not interfere with the images projected from the lens assembly to the members. Any keystoning effect caused by the angular relationship could be compensated for, if necessary, by tilted field lenses. The catadioptric nature of the lens assembly 60 (i.e., its combination of reflecting and refracting lens elements such as shown in U.S. Pat. No. 3,044,357 issued July 17, 1960 in the name of Linke) significantly modifies any aberrations induced by the dichroic mirrors. Accordingly, the color separation images of the document are faithfully transmitted to accurately expose the members to respectively form corresponding latent image charge patterns. It should be noted that if the photoconductive members are formed of strips of material on the drums spliced transverse to the direction of rotation, the logic and control unit L times the rotation of the respective drums such that the splices do not fall within the image receiving areas.

In operation of the described copier 10, three scanning cycles are required to make a single full color reproduction on a receiver sheet. Although drums 18*a*, 18*b*, and 18*c* are continuously rotated during the scanning cycles, only charger 22*c* is turned on during the first scanning cycle so that a latent image is formed and developed only on photoconductive member 16*c*. The logic and control unit L actuates the feeder 32 in timed relation to the first scanning cycle so that a receiver sheet is fed in register (by registration mechanism 34) into the transfer nip between member 16*c* and transfer roller 42*c* to be aligned with the developed image on member 16*c*. In the next scanning cycle, only charger 22*b* is turned on so that a latent image is formed and developed only on photoconductive member 16*b*. Because the distance between transfer nips is equal to an exposure area plus the spacing between exposure areas (interframe area), the developed image on member 16*b* and the transported receiver sheet arrive at the transfer nip in register (i.e., with the developed image in registration with the previously transferred image on the receiver sheet) so that transfer in such nip occurs in superimposed register. Similarly during the third scanning cycle, only charger 22*a* is turned on so that a latent image is formed and developed only on member 16*a*; and the developed image and the transported receiver sheet arrive at the transfer nip in register. Thus when the document has been scanned three times and the color separation images developed on the respective photoconductive members, the developed images reach their respective transfer nips in proper timed relation with arrival of the receiver sheet such that transfer of the images to the sheet occurs in superimposed register. If multiple reproductions of one original document are to be made, more than one charger is turned on by the logic and control unit L during all scanning cycles except the first and last cycle, and a receiver sheet is fed from supply 28 for each cycle except the last two. Accordingly the number of scanning cycles required to make the desired number of reproductions is equal to the number of reproductions to be made plus two (see Table).

TABLE

A. Number of Reproductions to be Made: one

| Scan No.: | 1 | 2 | 3 |
|---|---|---|---|
| charger 22a: | off | off | on |
| charger 22b: | off | on | off |
| charger 22c: | on | off | off |
| sheet feed: | yes | no | no |

B. Number of Reproductions to be Made: two

| Scan No.: | 1 | 2 | 3 | 4 |
|---|---|---|---|---|
| charger 22a: | off | off | on | on |
| charger 22b: | off | on | on | off |
| charger 22c: | on | on | off | off |
| sheet feed: | yes | yes | no | no |

C. Number of Reproductions to be Made: three

| Scan No.: | 1 | 2 | 3 | 4 | 5 |
|---|---|---|---|---|---|
| charger 22a: | off | off | on | on | on |
| charger 22b: | off | on | on | on | off |
| charger 22c: | on | on | on | off | off |
| sheet feed: | yes | yes | yes | no | no |

D. Number of Reproductions to be Made: n

| Scan No.: | 1 | 2 | 3 . . . n | n + 1 | n + 2 |
|---|---|---|---|---|---|
| charger 22a: | off | off | on . . . on | on | on |
| charger 22b: | off | on | on . . . on | on | off |
| charger 22c: | on | on | on . . . on | off | off |
| sheet feed: | yes | yes | yes . . . yes | no | no |

As can be appreciated from the above Table, the productivity of the electrophotographic copier 10 of this configuration is very high. That is, multiple full color reproductions are produced at a rate equal to that of a conventional monochrome copier plus the time to make two additional reproductions.

The invention has been described in detail with particular reference to a preferred embodiment thereof, but it will be understood that variations and modifications can be effected within the spirit and scope of the invention.

We claim:

1. In an electrophotographic copier for making multicolor reproductions of a multicolor original document, said copier including photoconductive means, means for forming latent image charge patterns on said photoconductive means respectively corresponding to primary color separation images of the original document, and means for developing such charge patterns with respective complementary colored marking particles, the improvement comprising:

a catadioptric lens assembly optically located between the original document and said photoconductive means, said lens assembly including dichroic mirrors spectrally sensitive respectively to primary colors and tilted respectively relative to each other to separate an image of such original document into primary color separation images and project such images respectively in straight line optical paths toward distinct spatial locations on said photoconductive means.

2. The invention of claim 1 wherein the improvement includes means located between the original document and said lens assembly for optically scanning such original document to project the image of such original document to said catadioptric lens assembly for separation by said tilted dichroic mirrors.

3. In an electrophotographic copier for making multicolor reproductions of a multicolor original document, said copier including a plurality of spaced photoconductive members, means associated with said photoconductive members for forming latent image charge patterns on such members respectively corresponding to primary color separation images of the original document, means for developing such patterns with respective complimentary colored marking particles, and means for transferring such developed patterns to a receiver sheet the improvement comprising:

means for projecting an image of an original document along a optical path toward said photoconductive members including a catadioptric lens assembly located in said path, said lens assembly having dichroic mirrors spectrally sensitive respectively to primary colors to separate an image of such original document into primary color separation images, said mirrors being relatively tilted to project said respective primary color separation images in separate straight line optical paths toward respective photoconductive members;

means for conveying a receiver sheet sequentially into registered transfer relation with said photoconductive members; and means for synchronizing operation of said charge pattern forming means, image projecting means, developing means, transfer means and receiver sheet conveying means such that developed patterns corresponding to projected color separation images are formed on respective photoconductive members, and then sequentially transferred in superimposed register to a receiver sheet to produce a multicolor reproduction of the multicolor original document.

4. The invention of claim 3 including a plurality of rotating drums supporting said plurality of photoconductive members respectively, said drums having respective axes of rotation transverse to the optical paths of said primary color separation images; and wherein said image projecting means includes means for optically scanning an original document, said synchronizing means synchronizing the scanning of said document with rotation of said drums so that the latent image charge patterns substantially correspond to the original document without image smearing on the photoconductive members.

5. The invention of claim 3 wherein said conveying means includes means for transporting a receiver sheet sequentially into contact with respective photoconductive members, and wherein said transfer means is located opposite the area of such contact to effect transfer of the developed patterns to such receiver sheet.

6. The invention of claim 5 wherein said transfer means includes a plurality of transfer rollers in juxtaposition with said photoconductive members respectively, and means for driving said transfer rollers at a peripheral speed equal to that of said photoconductive members; and wherein said transport means includes vacuum chambers located between transfer rollers, said chambers respectively having a ported wall adjacent to said members, and a moving perforated belt passing over said chambers and said transfer rollers, vacuum applied to said chambers being effective to tack a receiver sheet to said belt to be moved therewith sequentially into contact with said members.

7. The invention of claim 3 wherein said charge pattern forming means includes a plurality of chargers associated with said plurality of photoconductive members respectively; and wherein said synchronizing means selectively activates respective chargers, and in response to such activation activates said image projecting means so that latent image charge patterns are formed only on those photoconductive members required to be developed to transfer an image in superimposed register on a conveyed receiver sheet to form the multicolor reproduction.

8. In the electrophotographic copier for making multicolor reproductions of a multicolor original document, said copier including three spaced photoconductive members, three chargers associated with said three photoconductive members respectively for applying a uniform electrostatic charge to such members, means for optically scanning an original document to project an image of such document in an optical path toward said members to expose said members so that latent image charge patterns are formed on said photoconductive members respectively corresponding to primary color separation images of the original document, means associated with said photoconductive members for respectively developing such patterns with complimentary colored marking particles, and means in image transfer relation to said photoconductive members for transferring such developed patterns to a receiver sheet, the improvement comprising:

three rotatable drums, of equal diameter, supporting said three photoconductive members respectively, said drums being spaced apart such that respective portions of said photoconductive members in image transfer relation with said transfer means are in turn spaced apart a distance substantially equal to a distance measured along the photoconductive member corresponding to an exposure area plus the distance between the trail edge of an exposure area and the lead edge of the next exposure area;

means for rotating said drums at a peripheral speed substantially equal to the speed of the scanning means so that the latent image charge patterns substantially correspond to the original document without image smearing on the photoconductive members;

a catadioptric lens assembly located in said optical path to receive the projected image of the original document, said lens assembly including dichroic mirrors spectrally sensitive respectively to primary colors to separate such received image into primary color separation images, said mirrors being relatively tilted to project said respective primary color separation images in separate straight line optical paths respectively toward said photoconductive members;

means for conveying a receiver sheet sequentially into registered image transfer relation with respective photoconductive members and transfer means; and means for synchronizing the operation of said drum rotating means, chargers, scanning means, developing means, and receiver sheet conveying means such that when one multicolor reproduction of a multicolor original document is desired to be reproduced, the original document is scanned three times and respective chargers are activated during successive scans so that developed color separation image patterns corresponding to projected color separation images are formed on respective moving photoconductive members and arrive in image transfer relation with a receiver sheet conveyed by said conveying means to be transferred in superimposed register to such sheet; and when multiple reproductions of a multicolor original are desired to be reproduced, the original document is scanned a number of times equal to the number of desired reproductions plus two and respective chargers are selectively activated during such scans so that developed color separation image patterns corresponding to projected color separation images are formed on respective moving photoconductors and respectively arrive in image transfer relation with respective receiver sheets conveyed seriatim by said conveying means in response to such scans, except the last two, to be transferred in superimposed register to such sheets to form the multicolor reproductions.

9. Method for making multicolor reproductions of a multicolor original document comprising the steps of:

illuminating a multicolor original document a number of times equal to the number of desired reproductions plus two to obtain light images of such document;

separating such projected light images into primary color separation light images;

forming latent image charge patterns corresponding to the primary color separation light images;

developing such latent image charge patterns with complimentary colored marking particles;

conveying receiver sheets seriatim, in response to each illumination of the original document except the last two, sequentially into image transfer relation with developed images corresponding to primary color separation images; and transferring such developed images in superimposed register respectively to the receiver sheets to form multicolor reproductions of the multicolor original document on each of such sheets.

* * * * *